US005813885A

United States Patent [19]

Shen

[11] Patent Number: 5,813,885

[45] Date of Patent: Sep. 29, 1998

[54] SOCKET ASSEMBLY FOR LAMP

[76] Inventor: Wei Hong Shen, 6F, No. 416, Sec. 4, Jen Ai Road, Taipei, Taiwan

[21] Appl. No.: 783,669

[22] Filed: Jan. 15, 1997

[51] Int. Cl.[6] ..... H01R 17/00

[52] U.S. Cl. ..... 439/699.2; 362/226; 362/438; 313/318.11

[58] Field of Search ..... 439/552, 557, 439/619, 699.2, 346, 452, 469, 472; 362/226, 438; 313/318.01, 318.11

[56] References Cited

U.S. PATENT DOCUMENTS 5,535,109 7/1996 Moore et al. ..... 362/226
5,588,741 12/1996 Huang ..... 362/438

*Primary Examiner*—Hien Vu
*Assistant Examiner*—Yong Ki Kim
*Attorney, Agent, or Firm*—Rosenberg, Klein & Bilker

[57] ABSTRACT

A socket assembly for a lamp is provided that includes a triggering tab made from an insulating material. An isolating plate is disposed below the triggering tab. Each side of the isolating plate is provided with a shaft which has a threaded outer portion. Each shaft has a socket made from an electrically conductive material disposed thereon. Each socket is attached to a respective shaft by means of a hole formed through the socket. Each socket is provided with a slot for receiving and retaining a connecting pin of a light bulb. The threaded portion of each shaft extends through the hole for connection with a connecting rod made from an electrically conductive material. The connecting rod can be suitably supported by a supporting device. When a light shade is to be attached, a pair of shade fixing springs are applied that are attached to a respective annular groove of each connecting rod, the socket and the top of the shade. The fixing springs and socket assembly are sandwiched by triangular fins of the fixing springs. When the socket is rotated, the bulb is prevented from colliding with an inner wall of the light shade.

3 Claims, 10 Drawing Sheets

SOCKET ASSEMBLY FOR LAMP

BACKGROUND OF THE INVENTION

1. Field of the Invention

The present invention relates to a socket assembly for a lamp wherein the socket assembly is provided with excellent heat dissipation, quick assembly, and excellent electrical conductivity. On the other hand, when the socket is rotated, the bulb is prevented from bumping into the inner wall of the light shade.

2. Prior Art

As living standards have been upgraded, lighting devices have played a large role in the daily life of consumers. Having suitable and elegant lighting devices as part of indoor decorations, not only brings sufficient luminance, but also provides an aesthetic appearance as well. Accordingly, many attempts have been made to increase the function to lamps, such as providing wall fixtures, pendant fixtures, desk lamps, floor lamps and track lighting.

Nevertheless, the conventional socket assembly has low heat dissipation which may readily cause permanent damage to the plastic housing of the socket assembly, due to overheating. Additionally, because of poor assembly and installation of components, the electrical conductivity of conventional socket assemblies is also unsatisfactory. Further, if the socket assembly includes a light shade, the bulb mounted in the socket assembly may readily collide with the inner wall of the light shade.

SUMMARY OF THE INVENTION

It is the object of this invention to provide a novel socket assembly wherein the problems of poor electrical conductivity and heat dissipation can be readily solved by the present invention.

In order to achieve the object set forth, the socket assembly made according to this invention generally comprises a trigger-shaped tab made from an insulating material. An isolating plate is disposed below the trigger-shaped tab. Each side of the isolating plate is provided with a shaft which has a threaded portion at an outer portion. Each of the shafts is disposed with a socket made form electrically conductive material. The socket is attached to the shaft by means of a hole formed in the socket thereof. The socket is provided with a slot for receiving and retaining legs of a bulb. The threaded portion extends beyond the hole for connecting with a connecting rod made from electrically conductive material. The connecting rod can be suitably supported by a supporting device. Since the socket and connecting rod are made from electrically conductive material, it benefits excellent heat dissipation. Consequently, the damage to plastic parts can be reduced to a low level. As the connecting rod is locked with a threaded portion, it has a substantial connection with the socket. As a result, it has an excellent electrical conductive capability. When the bulb is to be attached to a light shade, a pair of shade fixing springs are applied which can be attached to an annular groove on the connecting rod, the socket and the top of the shade. The fixing spring and socket assembly are sandwiched by triangular fins thereof. When the socket is rotated, the bulb is prevented from colliding with the inner wall of the light shade.

BRIEF DESCRIPTION OF THE DRAWINGS

In order that the present invention may more readily be understood the following description is given, merely by way of example, with reference to the accompanying drawings, in which.

DETAILED DESCRIPTION OF THE PREFERRED EMBODIMENTS

Figure 1:
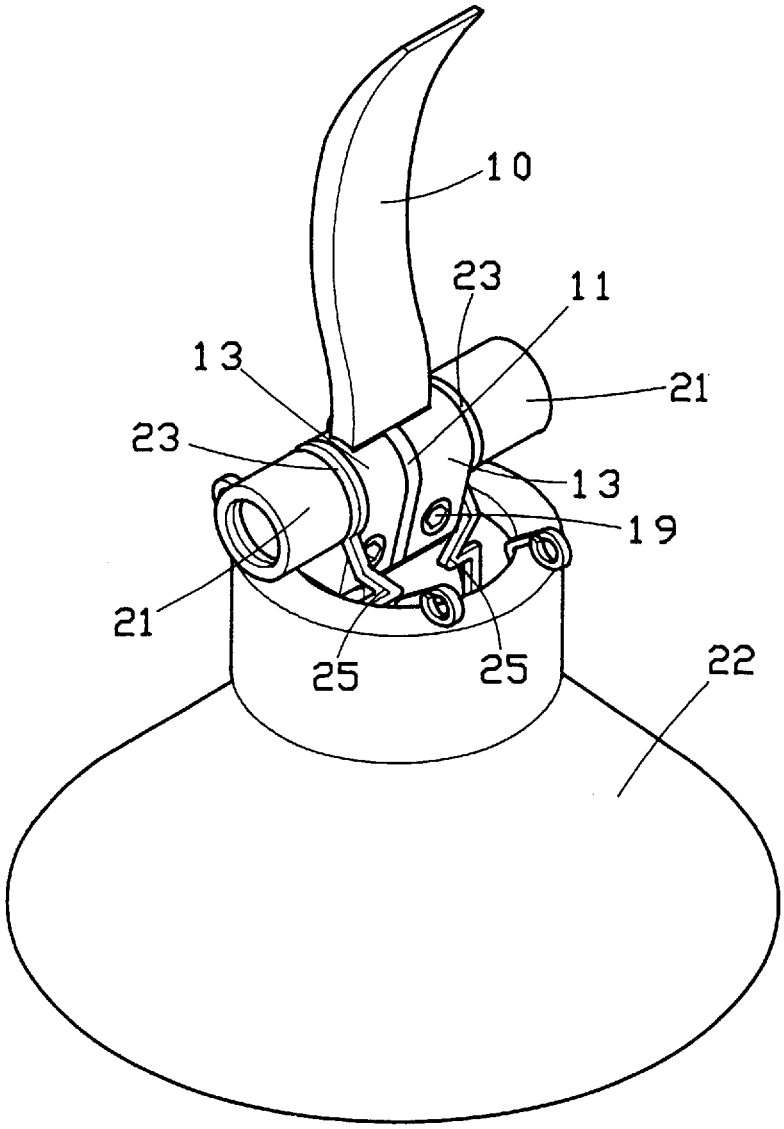
FIG. 1 is a perspective view of the socket assembly made according to the present invention.
Figure 2:
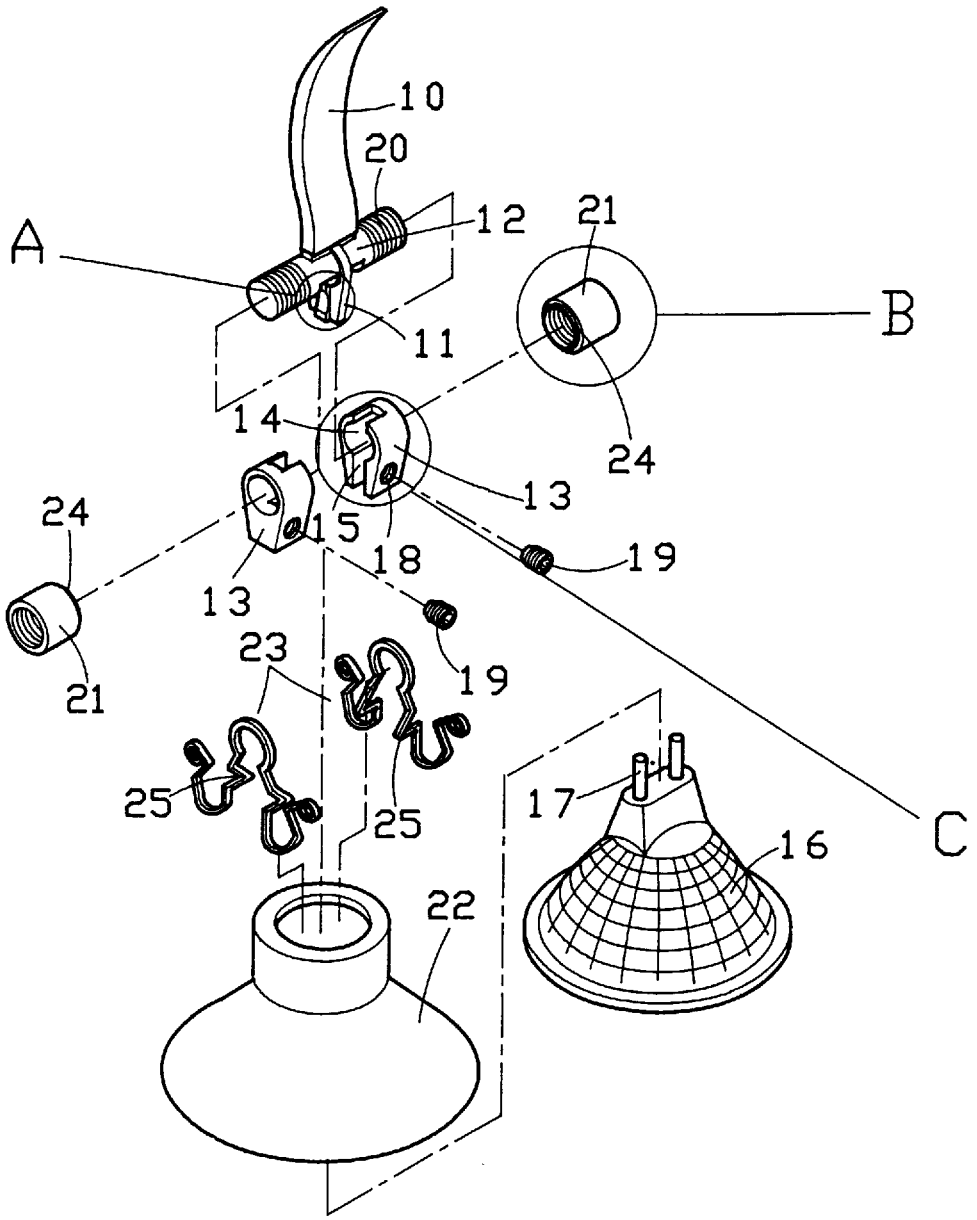
FIG. 2 is an exploded perspective view of the socket assembly made according to the present invention.
Figure 2A:
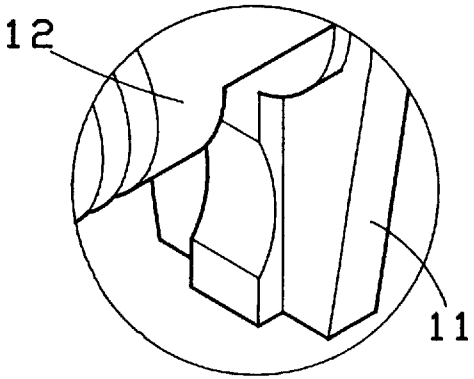
FIGS. 2A, 2B and 2C are enlarged views of the components circled in FIG. 2.
Figure 2B:
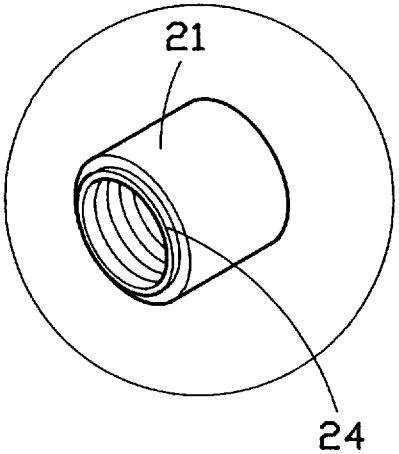
Figure 2C:
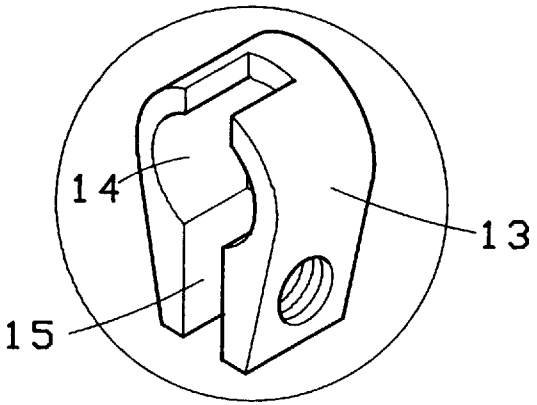
Figure 3:
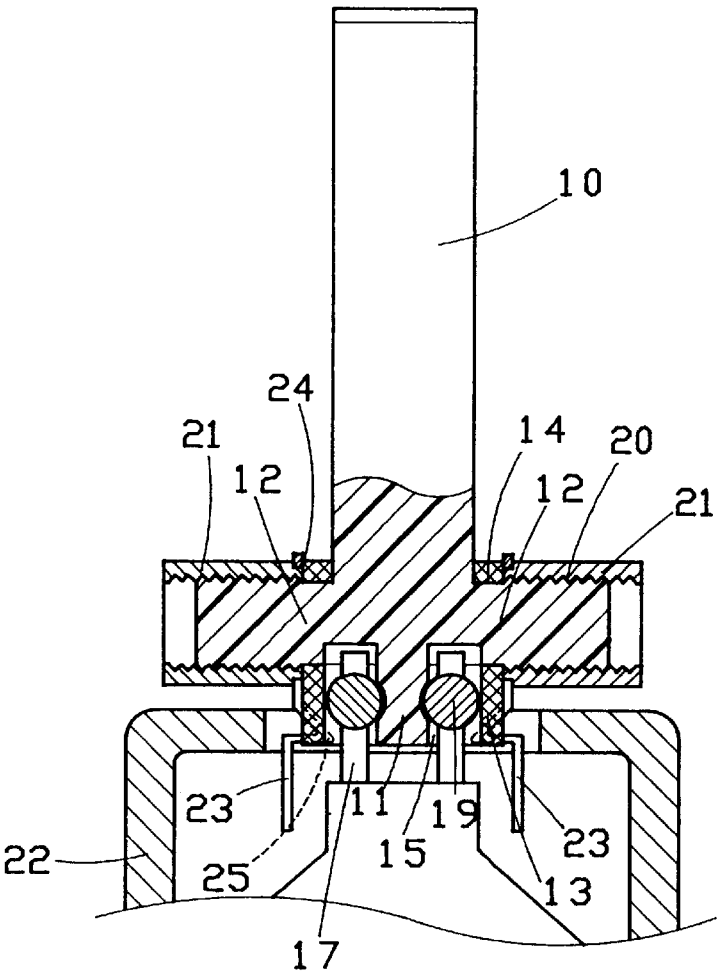
FIG. 3 is a cross-sectional view of the socket assembly made according to the present invention.
Figure 4:
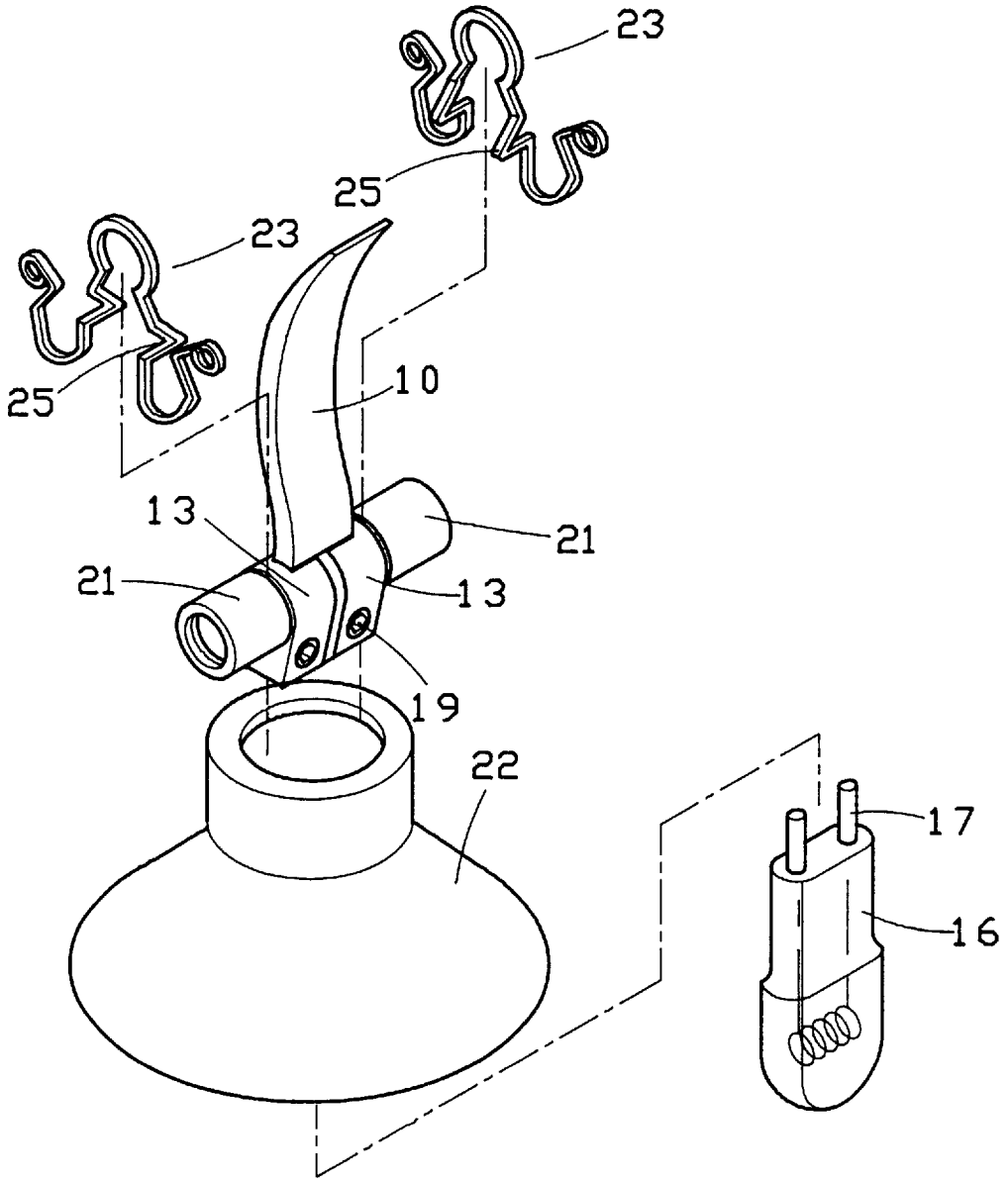
FIG. 4 is an exploded perspective view of the socket assembly wherein a bulb of another type is to be installed.

Referring to FIGS. 1, 2 and 3, there is shown, a perspective view, a perspective exploded view and a cross-sectional view of a lamp socket assembly of the instant invention. The socket assembly includes a trigger-shaped tab 10 made form an insulating material, such as plastic. The lower portion of the trigger-shaped tab 10 is formed with an isolating plate 11 having a pair of shafts 12 extending in opposite directions therefrom. The outer end portion of each shaft 12 is provided with a threaded portion 20. Each shaft 12 is provided with a socket 13 made from an electrically conductive material. The upper portion of each socket 13 has a hole 14 for receiving the shaft 12 therein. The lower portion of each socket 13 has a slot 15 for receiving and retaining a bulb 16. The conductor pins 17 of the bulb 16 are respectively retained within the slots 15 of the sockets 13. Each of the sockets 13 is provided with a threaded hole 18 for receiving a locking screw 19 therein to secure the attachment of bulb 16. The bulb 16 may be of another kind of configuration, as shown in FIG. 4.

When the shaft 12 is disposed in the sleeve hole 14, the threaded portion 20 of the shaft 12 is projected through the sleeve hole 14 for connection with a connecting rod 21 made from an electrically conductive material. The connecting rod 21 can be attached to a suitable supporting device (not shown) to complete the socket assembly.

Figure 5:
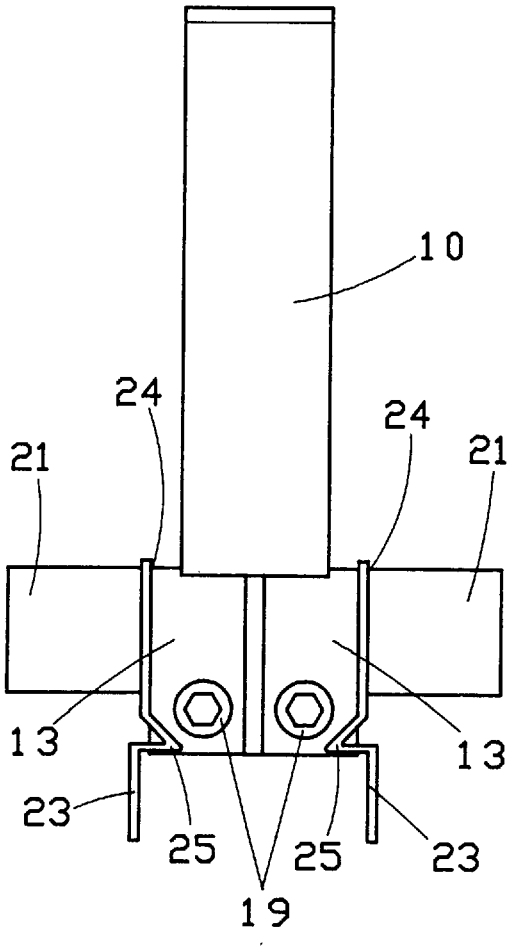
FIG. 5 is a side elevational view of the socket assembly wherein only part of the socket assembly is shown.

The bulb 16 can be incorporated with suitable light shade 22. A pair of shade fixing springs 23 are provided. Each shade fixing spring 23 is attached to an annular groove 24 of the connecting rod 21. Both sides of each shade fixing spring 23 are provided with a triangular fin 25. Those two shade fixing springs 23 can be attached to the top of the shade 22 by their outer ends, such that each socket 13 is sandwiched by two triangular fins 25 by a respective shade fixing spring 23, as shown in FIG. 5. Consequently, the light shade 22 is integrally assembled with the sockets 13 by means of the two triangular fins 25 of each spring 23. Accordingly, when the sockets 13 are rotated, the light shade 22 is rotated simultaneously with the bulb 16. In light of this, the bulb 16 will not collide with the light shade 22.

The socket assembly of the instant invention can be properly supported at a suitable position by a supporting bracket. The supporting bracket may also provide electricity to the sockets 13 via the connecting rods 21. Consequently, the bulb 16 coupled to the sockets 13 can be lit as it is switched on. Since the sockets 13 and the connecting rods 21 are bare metallic parts, accordingly, they have an excellent heat dissipation. As a result, damage to the plastic material can be reduced. Furthermore, the connecting rods 21 are locked by the respective threaded portions 20, they have a substantial connection with a respective socket 13, and a better electrical conductivity can also be ensured.

Figure 6:
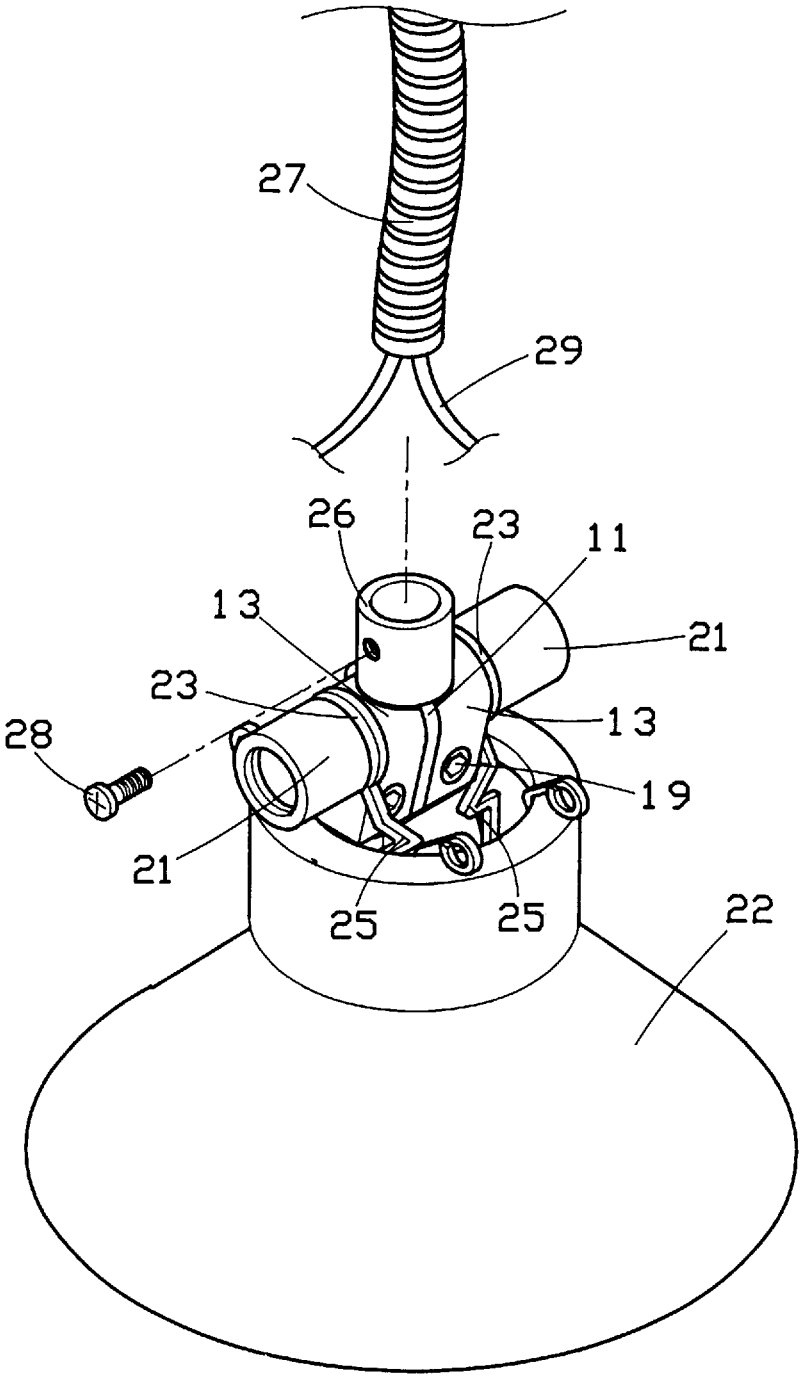
FIG. 6 is a second embodiment of the socket assembly made according to the present invention; and, FIG. 7 is a third embodiment of the socket assembly made according to the present invention.

Referring to FIG. 6, a perspective view of a second embodiment is shown. The trigger-shaped tab 10 is replaced by a tube 26. The tube 26 can be received within a bellows 27, which can be fixed by a screw 28. The other end of the bellows 27 is provided with a fixing device (not shown). Accordingly, the socket 13 can be well supported by the bellows 27. Additionally, the conductive wires 29 can be routed through the bellows 27 to provide electricity to the sockets 13. As a result, the bulb 16 coupled to the sockets 13 can be lit as it is switched on.

Figure 7:
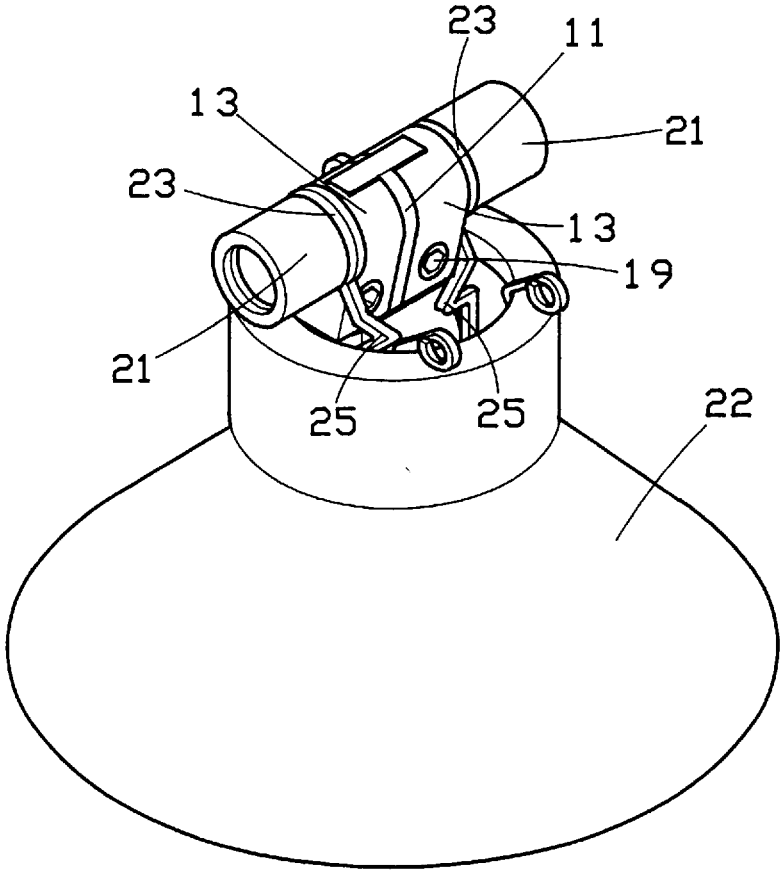

FIG. 7 discloses another perspective view of the socket assembly made according to this invention. In this embodiment, the trigger-shaped tab 10, of the first embodiment, that was disposed above the isolating plate 11 and shaft 12, are eliminated.

In summary, the socket made according to the present invention can readily solve the problems encountered by conventional socket assemblies. That is to say, the socket assembly made according to this invention may have excellent heat dissipation, excellent electrical conductivity, and the bulb will not interfere with the inner wall of the light shade.

While particular embodiments of the present invention have been illustrated and described, it would be obvious to those skilled in the art that various other changes and modifications can be made without departing from the spirit and scope of the invention. It is therefore intended that all such changes and modifications that are within the scope of the present invention be covered by the appended claims.

I claim:

1. A lamp socket assembly, comprising:

an electrical insulating member having a pair of shafts extending from opposing sides thereof and an isolating plate extending from a lower end thereof, each of said shafts having a threaded portion formed thereon;

a pair of socket members mounted on said electrical insulating member, each of said socket members being formed of an electrically conductive material and having a hole formed therethrough for passage of a respective one of said shafts therethrough, each of said socket members having a slot formed in a lower end thereof and a threaded hole formed in open communication with said slot for securing a connector pin of a light bulb disposed within said slot with a locking screw threadedly engaged with said threaded hole; and, a pair of connecting rods respectively threadedly engaged with said threaded portions of said pair of shafts, each of said connecting rods being formed of an electrically conductive material and in contiguous contact with a respective one of said pair of socket members.

2. The lamp socket assembly as recited in claim 1 further comprising a lamp shade and a pair of shade fixing springs sandwiching said pair of socket members for securing said lamp shade over a light bulb, each of said shade fixing springs being secured to an annular groove formed in a respective one of said pair of connecting rods and to an opening formed in said lamp shade.

3. The lamp socket assembly as recited in claim 1 further comprising a bellows coupled to said electrical insulating member for support thereof, said electrical insulating member being tubularly shaped for passage of electrical wires from said bellows therethrough.

* * * * *